US005671921A

United States Patent [19]

Quinlan

[11] Patent Number: 5,671,921

[45] Date of Patent: Sep. 30, 1997

[54] SEAL CARD GAME WITH MULTIPLE ADVANCED LEVEL CONTESTANTS

[75] Inventor: Paul D. Quinlan, Lee's Summit, Mo.

[73] Assignee: Universal Manufacturing Co., Inc., Kansas City, Mo.

[21] Appl. No.: 629,934

[22] Filed: Apr. 12, 1996

[51] Int. Cl.[6] ..... A63F 3/06; B42D 15/00

[52] U.S. Cl. ..... 273/139; 283/901; 283/903

[58] Field of Search ..... 273/139, 138 R, 273/269; 283/903, 901, 105, 103, 102, 101, 100, 98

[56] References Cited

U.S. PATENT DOCUMENTS

| | | |
|---|---|---|
| 3,900,219 | 8/1975 | D'Amato et al. . |
| 4,033,611 | 7/1977 | Johnsen . |
| 4,740,016 | 4/1988 | Konecny et al. . |
| 4,943,090 | 7/1990 | Fienberg . |
| 5,046,737 | 9/1991 | Fienberg . |
| 5,092,598 | 3/1992 | Kamille . |
| 5,128,293 | 7/1992 | Mullins . |
| 5,193,815 | 3/1993 | Pollard . |
| 5,407,200 | 4/1995 | Zalabak . |

*Primary Examiner*—William M. Pierce

*Attorney, Agent, or Firm*—Litman, McMahon and Brown, L.L.C.

[57] ABSTRACT

A seal card game with multiple advanced level contestants includes a plurality of individual playing cards with multiple graphical and numerical symbol combinations concealed thereon under break-open windows. Certain symbol combinations provide instant winner prizes, while others qualify a player for an advanced contest phase of play. A seal card includes a qualified advanced contestant identification area utilizing a sign-up register, an advanced contestant identification area utilizing break-open windows and an advanced contest prize area utilizing break-open windows. The seal card includes a sequence for the advanced contestants to open respective windows concealing prize amounts.

3 Claims, 2 Drawing Sheets

SEAL CARD GAME WITH MULTIPLE ADVANCED LEVEL CONTESTANTS

BACKGROUND OF THE INVENTION

1. Field of the Invention

The present invention relates generally to game materials for playing games of chance for monetary prizes, and in particular to a break-open card game with a plurality of individual playing cards and a seal card providing for the selection of advanced contestants from among a pool of qualified advanced contestants, with the outcome of the play at the advanced contestants level being undetermined prior to commencement of the advanced level play.

2. Description of the Related Art

Playing cards of various types are commonly used for gaming and a wide range of play actions can be accomplished with appropriate sets of playing cards and tickets. For example, lotteries which are run by state agencies are often conducted by using large numbers of custom printed lottery cards and tickets.

Tickets and other game materials used in playing such games of chance generally have several common characteristics. For instance, indicia for designating winners and their prize amounts are normally concealed prior to purchase in order to provide all players with similar chances at winning. The game materials are also generally designed to enhance the play action by contributing to the player appeal and excitement. Common techniques for building player interest include progressively increasing the size of a jackpot or maximum award and providing multiple opportunities for winning. Thus, games which provide relatively large prizes tend to generate significant levels of player interest, as do games which provide several chances in connection with a single card or ticket. For example, consolation prizes are often included in game play action. Successful game design also involves promoting the game and enticing players with graphics, game identifying trademarks and symbols which are chosen to enhance player interest and encourage repeat play.

Games of chance are also employed by charitable, social and fraternal organizations for fund raising. Bingo and other games of chance are popular among a wide variety of organizations because they provide dependable sources of revenue with minimal initial investments. Game materials used for fund raising purposes include jar tickets and break-open cards, the latter being characterized by windows which conceal the cards'potential as winners prior to purchase. Such break-open game cards have several important advantages. They are relatively easy to use by both the sponsoring organization and the players. Properly designed and manufactured, quality control can be exercised to provide a consistent result with safeguards against misuse and cheating. The break-open cards provide opportunities for multiple chances by providing multiple windows and the game materials can be printed with promotional material for enhancing player interest. Another important advantage of break-open game cards is that they are relatively inexpensive and thus maximize the available funds for pay out to the players in the form of cash awards and profit to the operator.

A typical prior art game card identifies multiple instant winners through the use of winning combinations of game symbols when the individual card windows are opened by the players. The winning symbol combinations are typically predetermined and are publicized in connection with sales of the cards, whereby players are seeking certain symbol combinations.

An additional feature commonly provided involves the use of a seal card wherein multiple players are qualified by a qualification symbol combination and are thereby entitled to participate in a bonus or advanced level of play. A popular type of seal card game involves a number of players having unique numbers printed under the break-open windows of their cards, a seal card being provided with one of those numbers concealed under a seal which is opened at the conclusion of play to determine a seal winner. The seal card game of the present invention provides enhanced advanced level play action with multiple winners from among a pool of qualified advanced contestants, with elements of chance involved in the determination of their respective prizes.

SUMMARY OF THE INVENTION

In the practice of the present invention, a multiple-contestant seal card game is provided which includes a plurality of individual playing cards, each of which includes a combination of graphical and/or numerical symbols printed on an inner surface and concealed by a break-open window. Certain of the symbol combinations designate instant winners, while others are used to qualify advanced contestants. A seal card includes a sign-up register for recording the names of the qualified advanced contestants and includes break-open windows for concealing symbol combinations which identify selected advanced contestants from among the qualified advanced contestant pool. An additional set of break-open windows are provided for concealing prize awards, from which the selected advanced contestants choose their respective break-open windows and determine their prize amounts upon opening same. The seal card includes a sequence for the advanced contestants to follow in opening the advanced contest prize windows.

OBJECTS AND ADVANTAGES OF THE INVENTION

The principle objects and advantages of the present invention include: providing a seal card game; providing such a seal card game which provides an advanced contest level for multiple contestants; providing such a seal card game which provides an element of chance in the outcome of an advanced contest thereof; providing such a seal card game which utilizes individual break-open cards or tickets for identifying instant winners; providing such a seal card game which provides multiple prize amounts in an advanced contest phase thereof; providing such a seal card game which stimulates player interest; providing such a seal card game which stimulates player interest; providing such a seal card game which is adaptable to various card counts, configurations, graphics and symbols; and providing such a seal card game which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
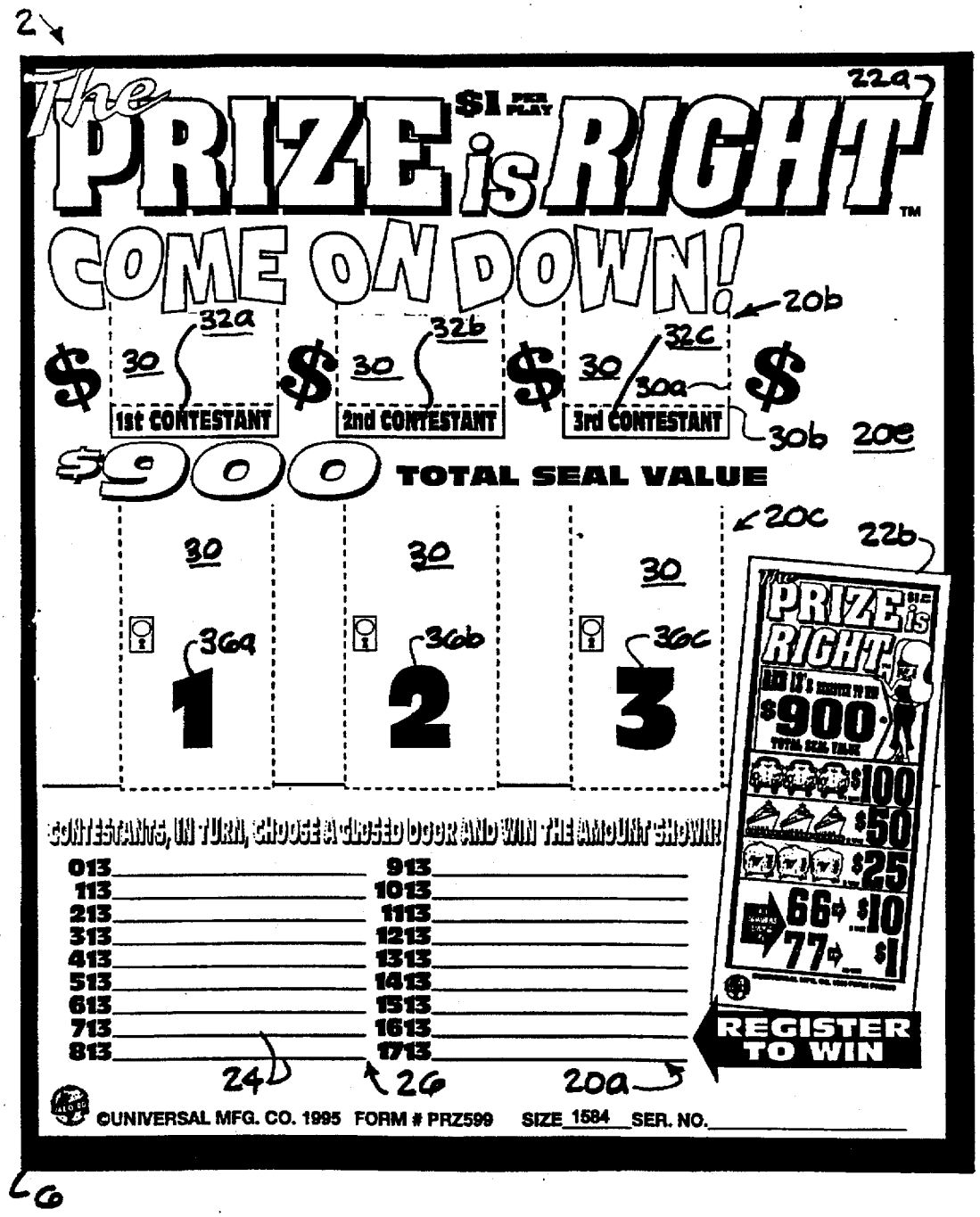
FIG. 1 is a front elevational view of a seal card for a seal card game embodying the present invention.
Figure 2:
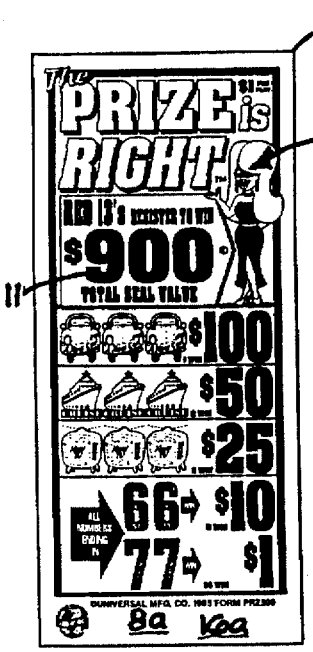
FIG. 2 is a front elevational view of an individual playing card.
Figure 3:
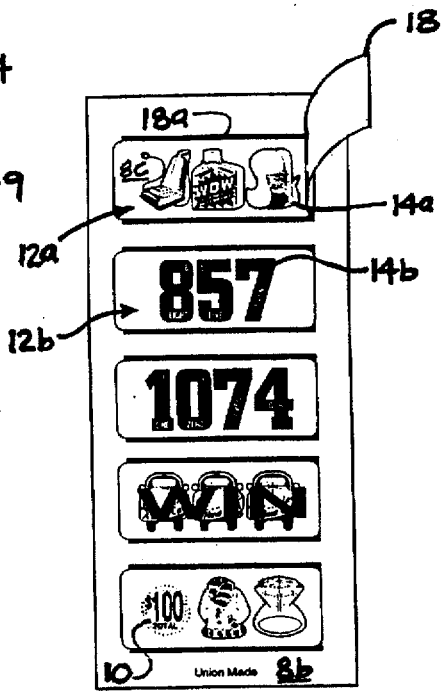
FIG. 3 is a rear elevational view of an individual playing card, showing the symbol combinations revealed.
Figure 4:
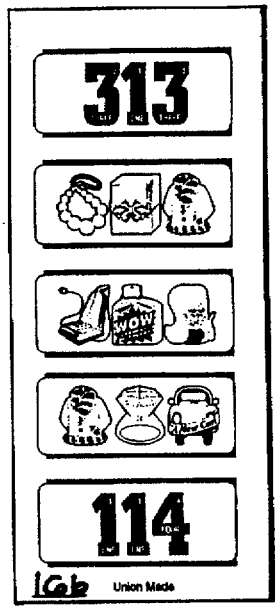
FIG. 4 is a rear elevational view of an individual playing card showing a different set of symbol combinations revealed.
Figure 5:
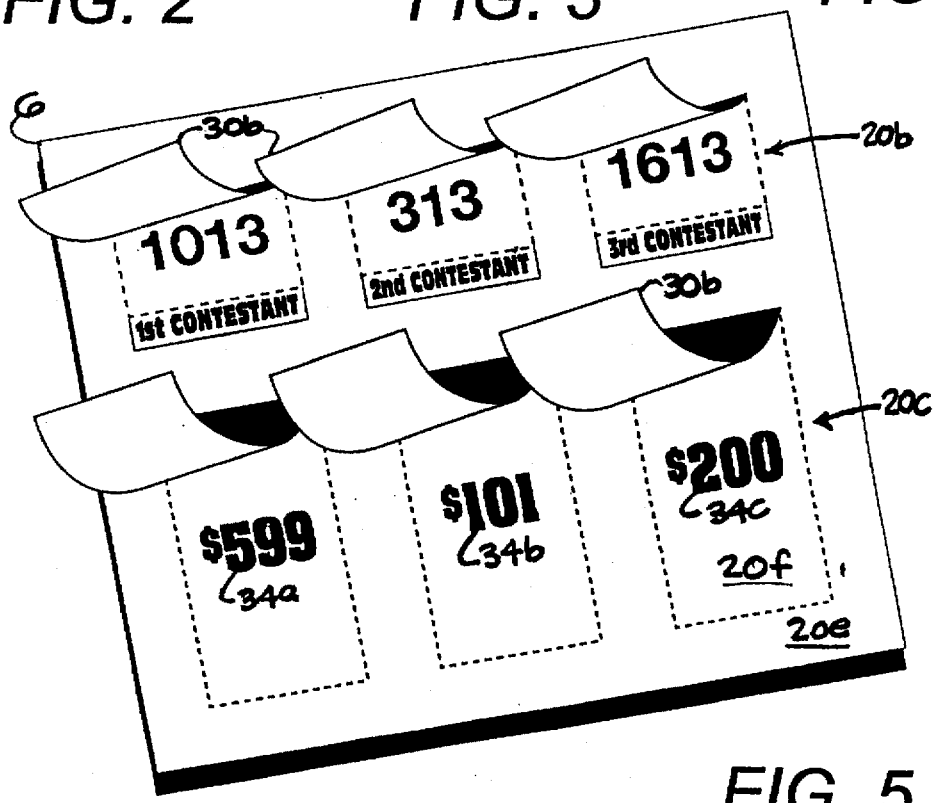
FIG. 5 is a fragmentary, front elevational view of the seal card, showing break-open windows thereon revealed to show the symbol combinations identifying advanced contestants and advanced contest prize awards.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a multiple-contestant seal card game embodying the present invention. The seal card game 2 generally comprises a set of individual play cards 4 and seal card means 6.

II. Individual Play Cards 4

The game 2 can comprise various numbers of individual play cards 4 corresponding to the size of a particular game. For example, the total card count may be governed by gaming rules and regulations, which vary among different jurisdictions. Moreover, card counts can be selected to control the durations of the games and also based upon economic considerations. For example, relatively low card counts can be utilized to conclude games more quickly, and relatively large card counts can be utilized to stimulate player interest by providing relatively large prize amounts.

Each play card 4 includes respective front and back faces 8*a*, 8*b* formed by front and back panels 16*a*, 16*b* respectively. Each card front face 8*a* has promotional information 9 printed thereon, such as an identification of the game, the card price, the winning game symbols and the prize amounts associated therewith. Each front panel 16*a* also includes a covered face 8*c* with graphic and numerical combinations 12*a*, 12*b* of graphic and numerical symbols 14*a*, 14*b* printed thereon. A total seal value 11 can also be printed on the card front face 8*a*. A card total prize 10 can be printed on the covered face 8*c* of each instant winner play card 4 and can be used to ensure that the proper amount is paid to instant winners, for example, in situations where a single card 6 has multiple instant winners.

The symbol combinations 12*a*, 12*b* are concealed prior to play by respective pull tabs 18 which are formed by perforated lines 18*a* in the back panel 16*b* whereby each pull tab 18 has a closed position concealing a combination of symbols 12 thereunder and an open position revealing same.

III. Seal Card Means 6

The seal card means 6 comprises a seal card with a qualified advanced contestant identifying area 20*a*, an advanced contestant selection area 20*b* and an advanced prize area 20*c*. The seal card 6 can also include promotional material 22 printed thereon such as a game-identifying trademark 22*a* and a reproduction 22*b* of an individual play card 4.

The qualified advanced player identification area 20*a* includes a plurality of three and four digit number combinations 12*b* adjacent respective name lines 24 to form a sign-up register 26. In the illustrated embodiment, the qualified advanced contestants are identified by the last two digits of numeric symbol combinations 12*b* on their individual play cards 4 comprising the digits "13". However, other symbol combinations or indicia could be used for identifying the qualified advanced contestants, such as other numeric combinations or graphic symbols.

The sign-up register has locations for a number of name lines 24, such as eighteen in the disclosed embodiment. From among these eighteen qualified advanced contestants, three will be selected by advanced contestant selection indicia 28 in the advanced contestant selection area 20*b*. Thus, the advanced contest selection indicia 28 comprise several (e.g., 1013, 313, and 1613) of the numerical symbol combinations 12*b*. The advanced contestant selection area 20*b* includes a plurality of break-open windows 30 formed by providing perforated lines 30*a* in a seal card front panel 20*e* for selectively covering indicia primed on a seal card back panel 20*f*. Tabs 30*b* are formed by respective perforated lines 30*a* and have closed positions concealing numerical symbol combinations 12*b* printed thereunder and open positions revealing same. Sequencing indicia 32*a,b,c* also primed on the seal card from panel 20*e* below respective tabs 30*b* in the advanced contestant selection area 20*b*, for example, first, second and third contestants respectively.

The prize area 20*c* includes additional, corresponding break-open windows 30 with prize amounts 34*a,b,c* printed thereunder and designating various prize amounts. The tabs 30*b* of the break-open windows 30 in the prize area 20*c* have prize window identifying indicia 36*a,b,c* printed thereon and corresponding to break-open windows numbered 1,2,3 respectively.

IV. Game Method

A method of playing the game 2 includes the step of initiating a game with a new set of play cards 4 and a new seal card 6. The play cards 4 are preferably sold out, with players having the advanced contestant qualification indicia on their play cards 4 signing the sign-up register 26 on the name lines 24 adjacent to their respective numerical symbol combinations 12*b* whereby they become qualified for the advanced contest.

After all of the individual play cards 4 have been played, all of the qualified advanced contestant numbers should have names associated with them. Instant winner prize amounts (e.g., $100, $50, $25, $10 and $1) can be paid out as the individual play cards 4 are played.

A first contestant can then be chosen by opening the first contestant break open window 30. The first contestant preferably has a choice of one of the prize windows 36 from among the three (i.e., "Door No. 1", "Door No. 2" or "Door No. 3" which are initially available. Thereafter the second contestant is entitled to select one of the remaining two prize windows 36 and the third contestant receives the prize amount under the remaining prize window 36. Thus, player interest is facilitated because the game's outcome is not determined until all of the prize windows 36 have been opened.

Variations on the game play could include varying the numbers of qualified advanced contestants, varying the numbers of selected advanced contestants and varying the prize amounts, as well as other variations within the spirit of the present invention.

It is to be understood that while certain forms of the present invention have been illustrated and described herein, it is not to be limited to the specific forms or arrangement of parts described and shown.

What is claimed and desired to be secured by Letters Patent is as follows:

1. A seal card game with multiple advanced level contestants, which includes:

(a) a plurality of individual play cards each including:

(1) a plurality of game symbol combinations printed thereon and a break-open window said break-open window having a closed position concealing a respective game symbol combination and an open position revealing same;

(2) a plurality of said game symbol combinations comprising graphic symbols and forming instant winner indicia entitling the holder to a monetary prize amount whereby prize amounts are pad out as the individual cards are played; and (3) a plurality of said game symbol combinations comprising multiple-digit numbers and forming advanced contestant qualifying indicia for identifying qualified advanced contestants; and (b) a seal card having:

(1) an advanced contestant identification area having said multiple digit numbers printed thereon and a sign-up list with signature lines adjacent said multiple-digit numbers for registering advanced contestants identified by said advanced contestant qualifying indicia;

(2) an advanced contestant selection area having a plurality of said multiple-digit numbers printed thereon and a plurality of break-open windows each having a closed position concealing a respective multiple-digit number and an open position revealing same, the number of said multiple-digit numbers in said selection area being less than the number of said multiple-digit-numbers in said identification area;

(3) a prize area having a plurality of different prize amounts printed on said card and a plurality of break-open windows each having a closed position concealing a respective prize amount and an open position revealing same;

(4) said advanced contestant selection area having a numerical sequence printed on said seal card in association therewith and defining a sequence for opening said prize amount break-open windows by each advanced contestant; and (5) said prize amounts in said prize area being printed in random order on said seal card behind said prize area break-open windows.

2. The game according to wherein said common numerical designation comprises the last two digits of a number comprising three or more digits.

3. The game according to claim 1 wherein said seal card includes:

(a) said advanced contestant identification area being located in a lower portion of said seal card;

(b) said selection area being located in an upper portions of said seal card; and (c) said prize area being located in a middle portion of said seal card.

* * * * *